US005576549A

United States Patent [19]

Hell et al.

[11] Patent Number: 5,576,549

[45] Date of Patent: Nov. 19, 1996

[54] ELECTRON GENERATING ASSEMBLY FOR AN X-RAY TUBE HAVING A CATHODE AND HAVING AN ELECTRODE SYSTEM FOR ACCELERATING THE ELECTRONS EMANATING FROM THE CATHODE

[75] Inventors: Erich Hell, Erlangen; Manfred Fuchs, Nuremberg, both of Germany

[73] Assignee: Siemens Aktiengesellschaft, Munich, Germany

[21] Appl. No.: 496,277

[22] Filed: Jun. 28, 1995

[30] Foreign Application Priority Data

Jul. 20, 1994 [DE] Germany ..... 44 25 683.3

[51] Int. Cl.[6] ..... H01J 29/48

[52] U.S. Cl. ..... 250/423 R; 250/423 P; 378/121; 378/136

[58] Field of Search ..... 250/423 R, 423 P; 378/136, 121; 313/103 CM, 105 CM

[56] References Cited

FOREIGN PATENT DOCUMENTS

| | | | |
|---|---|---|---|
| 331424 | 1/1921 | Germany . | |
| 2715483 | 10/1978 | Germany . | |
| 4026298 | 2/1992 | Germany . | |
| 1660073A1 | 6/1991 | U.S.S.R. | 378/121 |
| 1405256 | 9/1995 | United Kingdom . | |

OTHER PUBLICATIONS

"Optically Switched Pulsed X-Ray Generator," Ziegler, Rev. of Sci. Instr., vol. 43, No. 1, Jan. 1972, pp. 167–168.

*Primary Examiner*—Jack I. Berman
*Attorney, Agent, or Firm*—Hill, Steadman & Simpson

[57] ABSTRACT

An electron generating assembly for an x-ray tube has a thermionic cathode and an electrode system for accelerating electrons emitted by the thermionic cathode, and an electron multiplier disposed in the electron path. In order to achieve a given electron beam density, the electron beam current emitted by the cathode can be reduced dependent on the multiplication factor of the electron multiplier, thereby extending the service life of the overall assembly. The electron multiplier can be controllable.

17 Claims, 3 Drawing Sheets

ELECTRON GENERATING ASSEMBLY FOR AN X-RAY TUBE HAVING A CATHODE AND HAVING AN ELECTRODE SYSTEM FOR ACCELERATING THE ELECTRONS EMANATING FROM THE CATHODE

BACKGROUND OF THE INVENTION

1. Field of the Invention

The present invention is directed to an electron generating assembly for an x-ray tube, of the type having a cathode and an electrode system for accelerating the electrons emitted from the cathode.

2. Description of the Prior Art

X-ray tubes are known that have an electron generating assembly with a helical or serpentine cathode as the electron emitter formed by tungsten wire. This tungsten wire must be heated to high temperatures for the emission of electrons, particularly when high electron current densities must be achieved. Tungsten evaporates at these temperatures and becomes brittle, the useful life of the X-ray tube being limited as a result. Moreover, a coating of tungsten is formed on the inside wall of the glass enclosure of the X-ray tube with usage over time, this likewise being undesirable.

For extending the service life of an X-ray tube, German 40 26 298 disclosed an x-ray tube wherein the electron emitter is manufactured of a cathode material having a low electron affinity. As a result, the cathode temperature can be lowered given the same electron emission, and thus the service life can be extended.

German Patent 331 424 discloses a Lilienfeld tube, particularly an X-ray tube, having a drilled electrode, electrons being triggered at the walls of the opening on the basis of a primary event. The primary event is triggered by a primary discharge that occurs between an incandescent lamp and the X-ray cathode. As many electrons as possible are intended to be triggered for each electron absorbed by the cathode on the basis of the fashioning of the opening.

In an article "Optically Switched Pulsed X-ray Generator," Ziegler et al. The Review of Scientific Instruments, Vol.43, No. 1, January 1972, pp. 167 and 168, an x-ray generator is described having an electron generating assembly that a cold cathode formed by a photocathode which emits electrons controlled by a light source, an electron multiplier, and an electrode system for accelerating and focussing the electrons emanating from the photocathode onto an anode.

SUMMARY OF THE INVENTION

An object of the present invention is to provide an electron generating assembly having a hot cathode, such as a thermionic cathode, having a service life which is extended compared to known assemblies of this type.

This object is inventively achieved in an electron generating assembly having a glow cathode followed by an electron multiplier.

An advantage of the invention is that electrons emanating from the thermionic cathode are accelerated by the electrode system onto the electron multiplier and are multiplied thereby. Dependent on the multiplication factor, the electron current density emitted by the thermionic cathode can be reduced given the same electron current density compared to prior art assemblies, the service life thus being enhanced considerably.

It is advantageous when the electrons emanating from the electron multiplier are focussed onto a target by a following, focussing electrode system. The electrons emanating from the electron multiplier can thus be concentrated onto the target.

It is advantageous to form the electron multiplier as a multi-channel plate or as an apertured plate stack. It is especially advantageous when the electron multiplier is controllable, so that the gain factor can be set and/or modified. In order to be able to achieve a beneficial, selectable temperature distribution in the electron multiplier, the channels thereof can be controllable via a control unit.

The advantages of the embodiment employing a controllable electron multiplier carry over to electron generators employing a cold cathode, such as a photocathode.

DESCRIPTION OF THE PREFERRED EMBODIMENTS

Figure 1:
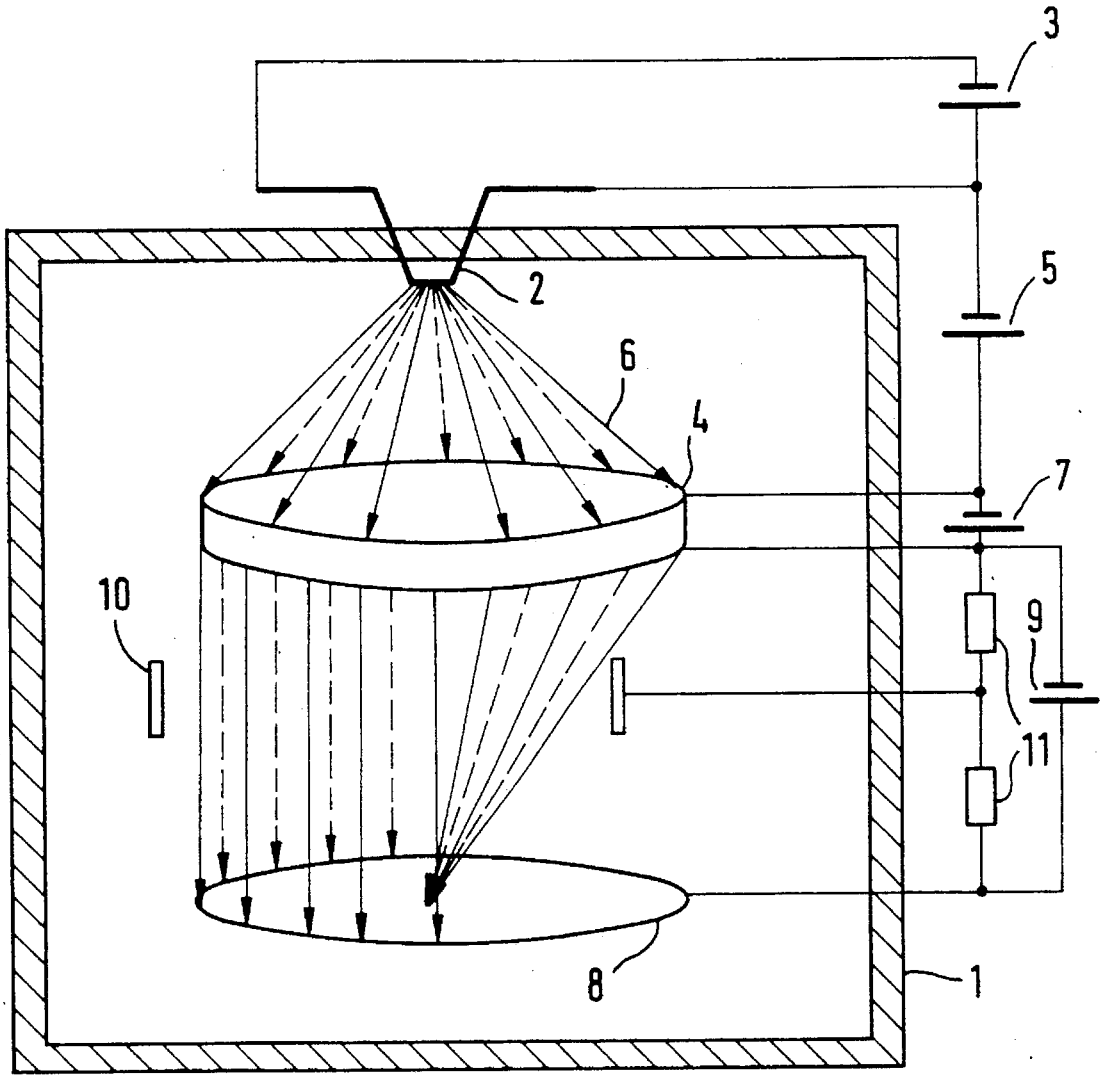
FIG. 1 is a schematic illustration of a first embodiment of an electron generating assembly constructed in accordance with the principles of the present invention.

In FIG. 1, the housing 1 of an X-ray tube (shown schematically) contains a thermionic cathode 2 that is connectable to a filament voltage source 3. In accordance with the invention, the thermionic cathode 2 is followed by an electron multiplier 4 which forms a broadband cathode and which can be implemented as a multi-channel plate or as an apertured plate stack. Such a multi-channel plate is disclosed, for example, in United Kingdom Specification 14 05 256, and an apertured plate stack is disclosed, for example, in German OS 27 15 483. A voltage of a second voltage source 5 can be applied between the electron multiplier 4 and the thermionic cathode 2, so that the electrons emanating from the thermionic cathode 2 are accelerated to the electron multiplier 4 as primary electrons 6. A third voltage source 7 is connectable to the electron multiplier 4, the gain factor being capable of being set dependent on the voltage of this third voltage source 7. As secondary electrons, the electrons emanating from the electron multiplier 4 are accelerated onto the anode 8 by a voltage of a fourth voltage source 9 that can be applied to the anode 8 as target and to the electron multiplier 4. An electrode system 10 that focusses electrons is preferably arranged between the electron multiplier 4 and the anode 8, this electrode system 10 having a plurality of electrodes such as annular or apertured disks to which the voltage of a fifth voltage source 11 can be applied. The secondary electrons are thus focussed onto the anode 8. The anode 8 can be a fixed or rotating anode for generating X-radiation.

Figure 2:
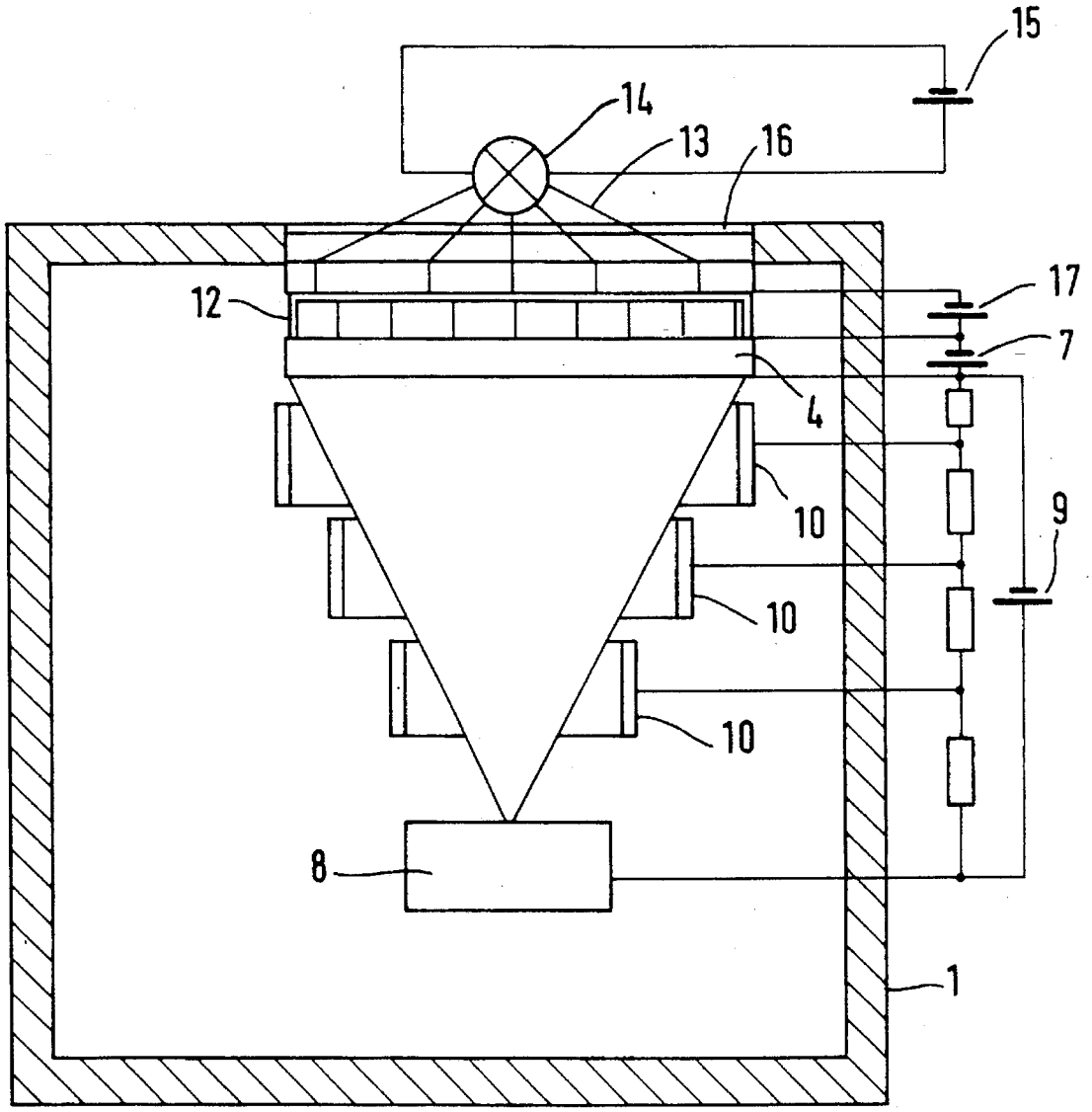
FIG. 2 is a schematic illustration of a second embodiment of an electron generating assembly constructed in accordance with the principles of the present invention.

In the exemplary embodiment of an electron generating assembly for an x-ray tube shown in FIG. 2, elements that have already been assigned reference characters in FIG. 1 are identified with the same reference characters. Differing from the exemplary embodiment of FIG. 1, the cathode of the device of FIG. 2 is a photocathode 12. The photocathode 12 receives radiation 13 from a radiation source 14, which is a light source in the exemplary embodiment and is connected to a sixth voltage source 15. The light radiation emerging from the radiation source 14 passes through a window 16 in the housing 1 onto the photocathode 12 and generates primary electrons that are accelerated onto the electron multiplier 4 by a voltage of a seventh voltage source 17 applied to the photocathode 12 and to the electron multiplier 4. The secondary electrons emanating from the electron multiplier 4 are focussed via the aforementioned electrode system 10 and are accelerated onto the anode 8 by the voltage that can be applied between the electron multiplier 4 and the anode 8.

Figure 3:
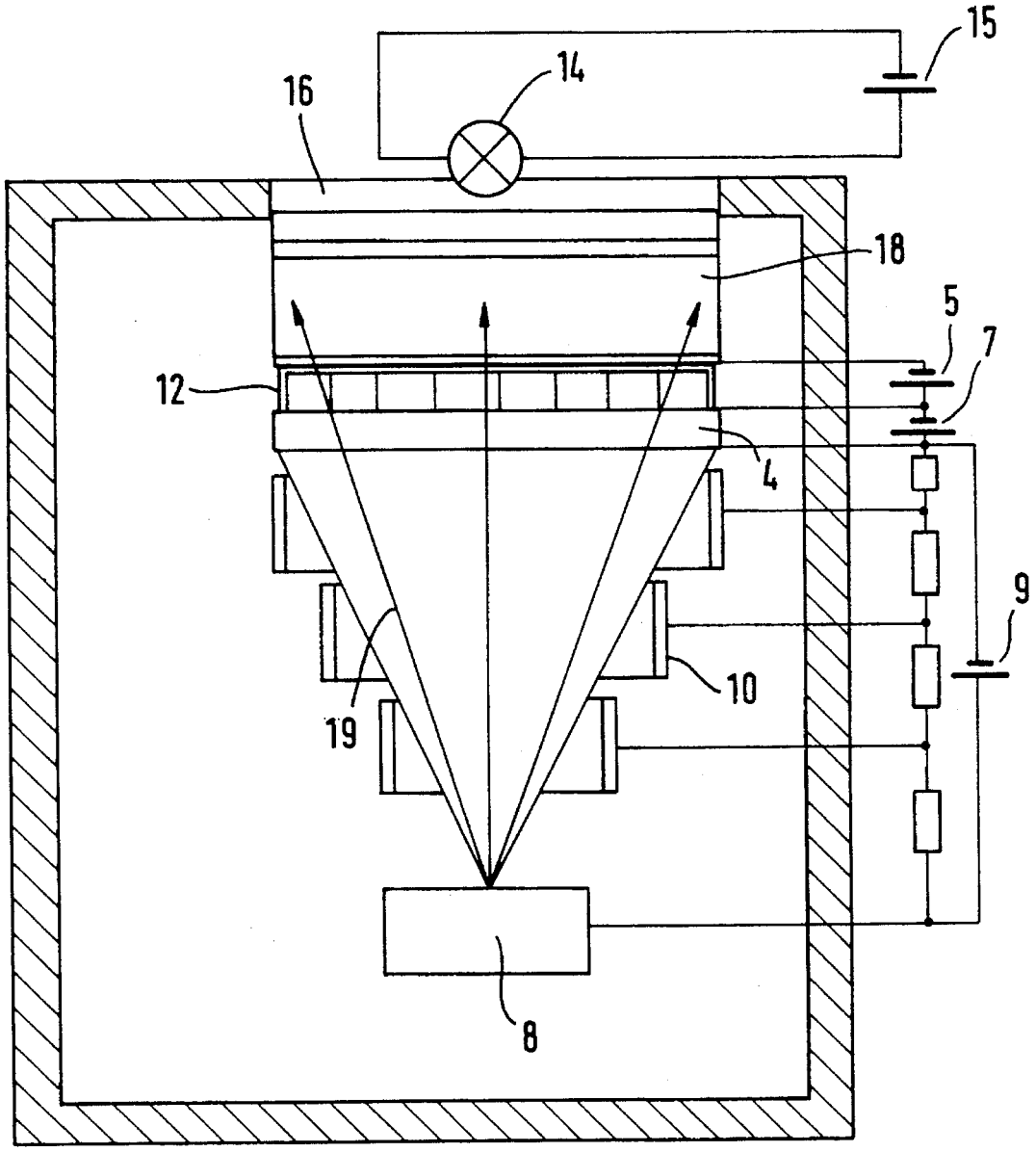
FIG. 3 is a schematic illustration of a this embodiment of an electron generating assembly constructed in accordance with the principles of the present invention.

In the electron generating assembly shown in FIG. 3, again elements that have already been provided with reference characters in FIG. 1 and FIG. 2 are identified with the same reference characters. This electron generating assembly has a radiation absorption layer 18 preceding the electron multiplier 4 that converts x-radiation 19 emanating from the anode 8 into light radiation, and which can be composed, for example, of CsI (Na) or NaI (Tl), etc. The photocathode 12 that follows the radiation absorption layer 18 converts this light radiation into primary electrons. The radiation source 14 is thereby in the form of an ignition lamp that is arranged such that light emitted thereby passes through the window 16 onto the photocathode 12 for activating the x-ray tube due to the generation of primary electrons. As already set forth, the generated primary electrons generate secondary electrons that are accelerated onto the anode 8 and are focussed thereon. Since the x-radiation 19 emanating from the anode 8 is not completely coupled out of the x-ray tube, the x-radiation 19 is also incident on radiation absorption layer 18, as a result of which light emitted by the layer 18 in turn generates primary electrons in the photocathode 12. The radiation source 14 thus serves the purpose of activating and controlling the x-ray tube. The thermionic cathode 2 shown in FIG. 1 can also be used as the radiation source 14.

The geometry of the focal spot, i.e. the point of incidence of the secondary electrons on the anode 8, is thus not dependent on the size and shape of the thermionic cathode as in known x-ray tubes, but can be set or varied on the basis of the geometry of the electron multiplier 4 and the following electrode system 10. The thermionic cathode 2 of the electron generating assembly shown in FIG. 1 can thus be fashioned relatively large, so that the electron current density of the thermionic cathode 2 can be reduced, and thus the service life thereof can be substantially extended.

It is within the scope of the invention for the electron multiplier 4 to have controllable channels, so that regions of the electron multiplier 4 can be controlled for the emission of secondary electrons. As a result, the thermal load on the electron multiplier 4 can be beneficially influenced dependent on the operating condition of the x-ray tube. The voltages of the voltage sources 3, 5, 7 and 9 are also preferably adjustable or variable via control means (not shown).

It is also possible within the scope of the invention to connect two or more apertured plate stacks and/or multi-channel plates or a combination of apertured plate stacks and multi-channel plates following one another in order to increase the gain.

Although modifications and changes may be suggested by those skilled in the art, it is the intention of the inventors to embody within the patent warranted hereon all changes and modifications as reasonably and properly come within the scope of their contribution to the art.

We claim as our invention:

1. An electron generating assembly for an x-ray tube, said electron generating assembly comprising:

a thermionic cathode which emits electrons;

electrode means for accelerating the electrons emitted from the thermionic cathode; and an electron multiplier disposed in a path of said electrons emitted by said thermionic cathode;

a radiation absorption layer disposed in said electron path preceding said electron multiplier.

2. An electron generating assembly as claimed in claim 1 wherein said means for accelerating the electrons comprises a focussing electrode system for focussing said electrons.

3. An electron generating assembly as claimed in claim 1 wherein said electron multiplier has at least one adjustable characteristic, and said assembly further comprising control means for controlling said electron multiplier for adjusting said characteristic.

4. An electron generating assembly as claimed in claim 1 wherein said electron multiplier comprises a multi-channel plate.

5. An electron generating assembly as claimed in claim 1 wherein said electron multiplier comprises an apertured plate stack.

6. An electron generating assembly for an x-ray tube, said electron generating assembly comprising:

a light source;

a photocathode which emits electrons controlled by said light source, said electrons traveling in an electron path;

an electron multiplier disposed in said electron path having a plurality of channels therein through which said electrons pass;

control means for controlling said electron multiplier for selecting said channels through which said electrons pass; and electrode means for accelerating said electrons emitted by said cathode and for focussing said electrons onto a target.

7. An electron generating assembly as claimed in claim 6 wherein said electron multiplier comprises a multi-channel plate.

8. An electron generating assembly as claimed in claim 6 wherein said electron multiplier comprises an apertured plate stack.

9. An electron generating assembly as claimed in claim 6 further comprising a radiation absorption layer disposed in said electron path preceding said electron multiplier.

10. An electron generating assembly as claimed in claim 6 further comprising means for pulsing said light source.

11. An electron generating assembly as claimed in claim 6 further comprising a radiation absorption layer preceding said photocathode.

12. An electron generating assembly for an x-ray tube, said electron generating assembly comprising:

a radiation source;

a photocathode which emits electrons controlled by said radiation source, said electrons traveling in an electron path;

an electron multiplier disposed in said electron path having a plurality of channels therein through which said electrons pass;

control means for controlling said electron multiplier for selecting said channels through which said electrons pass; and electrode means for accelerating said electrons emitted by said cathode and for focussing said electrons onto a target.

13. An electron generating assembly as claimed in claim 12 wherein said electron multiplier comprises a multi-channel plate.

14. An electron generating assembly as claimed in claim 12 wherein said electron multiplier comprises an apertured plate stack.

15. An electron generating assembly as claimed in claim 12 further comprising a radiation absorption layer disposed in said electron path preceding said electron multiplier.

16. An electron generating assembly as claimed in claim 12 further comprising means for pulsing said radiation source.

17. An electron generating assembly as claimed in claim 12 further comprising a radiation absorption layer preceding said photocathode.

* * * * *